US011445828B2

(12) United States Patent
Fan

(10) Patent No.: US 11,445,828 B2
(45) Date of Patent: Sep. 20, 2022

(54) NECK PILLOW BAG

(71) Applicant: Eagle Fan, Hsinchu Hsien (TW)

(72) Inventor: Eagle Fan, Hsinchu Hsien (TW)

( * ) Notice: Subject to any disclaimer, the term of this patent is extended or adjusted under 35 U.S.C. 154(b) by 310 days.

(21) Appl. No.: 16/865,695

(22) Filed: May 4, 2020

(65) Prior Publication Data

US 2021/0337970 A1 Nov. 4, 2021

(51) Int. Cl.
*A47C 7/38* (2006.01)
*A47G 9/10* (2006.01)

(52) U.S. Cl.
CPC ..... *A47C 7/383* (2013.01); *A47G 9/1081* (2013.01); *A47G 2009/1018* (2013.01)

(58) Field of Classification Search
CPC ..... A47C 7/38; A47C 7/383; A47C 7/386; A47G 9/10; A47G 9/1072; A47G 9/1081; A47G 2009/1018
See application file for complete search history.

(56) References Cited

U.S. PATENT DOCUMENTS 5,503,456 A * 4/1996 Rossini ..... A47C 7/425 224/586
11,141,010 B1 * 10/2021 Mitchell ..... A47C 20/027
2005/0121962 A1 * 6/2005 Gold ..... A47D 15/006 297/399
2007/0052274 A1 * 3/2007 Morphew ..... A47D 15/00 297/392
2014/0000034 A1 * 1/2014 Alexander ..... A47G 9/1081 5/636
2017/0127858 A1 * 5/2017 Teh ..... A47G 9/1045
2019/0320798 A1 * 10/2019 Bly ..... A47G 9/0253
2020/0128980 A1 * 4/2020 Hanifi ..... A47G 9/1081
2020/0178709 A1 * 6/2020 Brown ..... G09F 23/06
2020/0214452 A1 * 7/2020 DuPré ..... A47G 9/1081
2020/0231074 A1 * 7/2020 Pierce ..... A47C 7/386
2021/0127867 A1 * 5/2021 Lee ..... A47C 7/383

* cited by examiner

*Primary Examiner* — Robert G Santos
*Assistant Examiner* — George Sun
(74) *Attorney, Agent, or Firm* — Lin & Associates Intellectual Property, Inc.

(57) ABSTRACT

A neck pillow bag is provided, comprising a main body and at least one pillow body; the main body further comprising a first casing, a second casing, an accommodating space and a fixing portion, the accommodating space being formed between the first casing and the second casing, the first casing and the second casing being partially connected so that the first casing able to be opened and closed with respect to the second casing, and the fixing portion being disposed on the second casing; the at least one pillow body being disposed inside the accommodating space, a first end of the at least one pillow body being connected to the main body, and a second end of the at least one pillow body being optionally retrievable from the accommodating space.

7 Claims, 7 Drawing Sheets

NECK PILLOW BAG

BACKGROUND OF THE INVENTION

1. Field of the Invention

The present invention relates generally to a neck pillow structure, and more particularly, to a neck pillow bag with a casing able to store a neck pillow and to fix the neck.

2. The Prior Arts

A neck pillow structure is a pillow, specifically a neck pillow for the human neck, which can effectively support the human cervical spine and maintain the normal physiological curve of the cervical spine, thereby reducing fatigue of the human neck.

The conventional neck pillow structure is widely used in places where a user needs to sit and sleep, such as riding on a vehicle, the vehicle can be a car, train, bus or aircraft. The conventional neck pillow structure prevents the users from neck pain and stiff neck muscles caused by insufficient neck support when sitting and sleeping, which may further lead to frequent headaches and dizziness.

When in use, because the conventional neck pillow structure is often U-shaped, the user put the U-shaped opening of the conventional neck pillow structure around the neck; when the user sleeps, the user can receive sufficient support through the neck pillow to improve the blood circulation of the neck, and avoid the situation of falling pillows.

However, despite the support of the neck pillow, during long-distance travel, when the user is sleeping on the seat, the body may be skewed and tilted, which may easily cause trouble to passengers in adjacent seats.

Furthermore, since the conventional neck pillow structure occupies a certain space, it is more inconvenient to carry and it is also inconvenient to store after use.

SUMMARY OF THE INVENTION

A primary objective of the present invention is to provide a neck pillow bag, which can be installed on a seat and fixes the neck of the human body in position, to prevent the user from leaning and tilting when sitting and sleeping on the seat.

Another objective of the present invention is to provide a neck pillow bag with a casing for storing the neck pillow, which is convenient for users to carry, store and place.

To achieve the aforementioned objectives, the present invention provides a neck pillow bag, comprising a main body and at least one pillow body; the main body further comprising a first casing, a second casing, an accommodating space and a fixing portion, the accommodating space being formed between the first casing and the second casing, the first casing and the second easing being partially connected so that the first casing able to be opened and closed with respect to the second casing, and the fixing portion being disposed on the second casing; the at least one pillow body being disposed inside the accommodating space, a first end of the at least one pillow body being connected to the main body, and a second end of the at least one pillow body being optionally retrievable from the accommodating space.

In a preferred embodiment of the present invention, the first casing and the second casing are connected through a mechanism of glue, seam or pivot.

In a preferred embodiment of the present invention, the main body further comprises an assembly portion; the assembly portion comprises a first connector and a second connector, the first connector is disposed on the second casing, the second connector is disposed on the first casing; when the first connector and the second connector are assembled, the first casing and the second casing are connected and fixed; when the first connector and the second connector are not assembled, the first casing and the second casing are separated.

In a preferred embodiment of the present invention, the fixing portion comprises two assembly buckles and a fastening strap; the two assembly buckles are respectively disposed at both ends of the fastening strap, and the two assembly buckles are detachably connected with each other.

In a preferred embodiment of the present invention, the at least one pillow body is provided inside with one of a plurality of styrofoam balls, foam, or latex.

In a preferred embodiment of the present invention, the neck pillow bag comprises two pillow bodies and two connection portions, which are respectively disposed on the second ends of the two pillow bodies, and the two connection portions are detachably assembled with each other.

In a preferred embodiment of the present invention, the neck pillow bag further comprises a zipper; the zipper is disposed at edges of the first casing and the second casing to allow the first casing and the second casing to open or close with respect to each other.

The advantages of the present invention is that the main body is fixed to the seat by the fixing portion, and the two pillow bodies surround the neck of the passenger, and are fastened together by the connection portions, so as to prevent the user from leaning or tilting to bother passengers in adjacent seats when the user sleeps in the seat.

Furthermore, the present invention uses the accommodation space of the main body to store the pillow bodies after the user uses the pillow bodies, which is convenient for the user to carry; store and place.

BRIEF DESCRIPTION OF THE DRAWINGS

The present invention will be apparent to those skilled in the art by readings the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
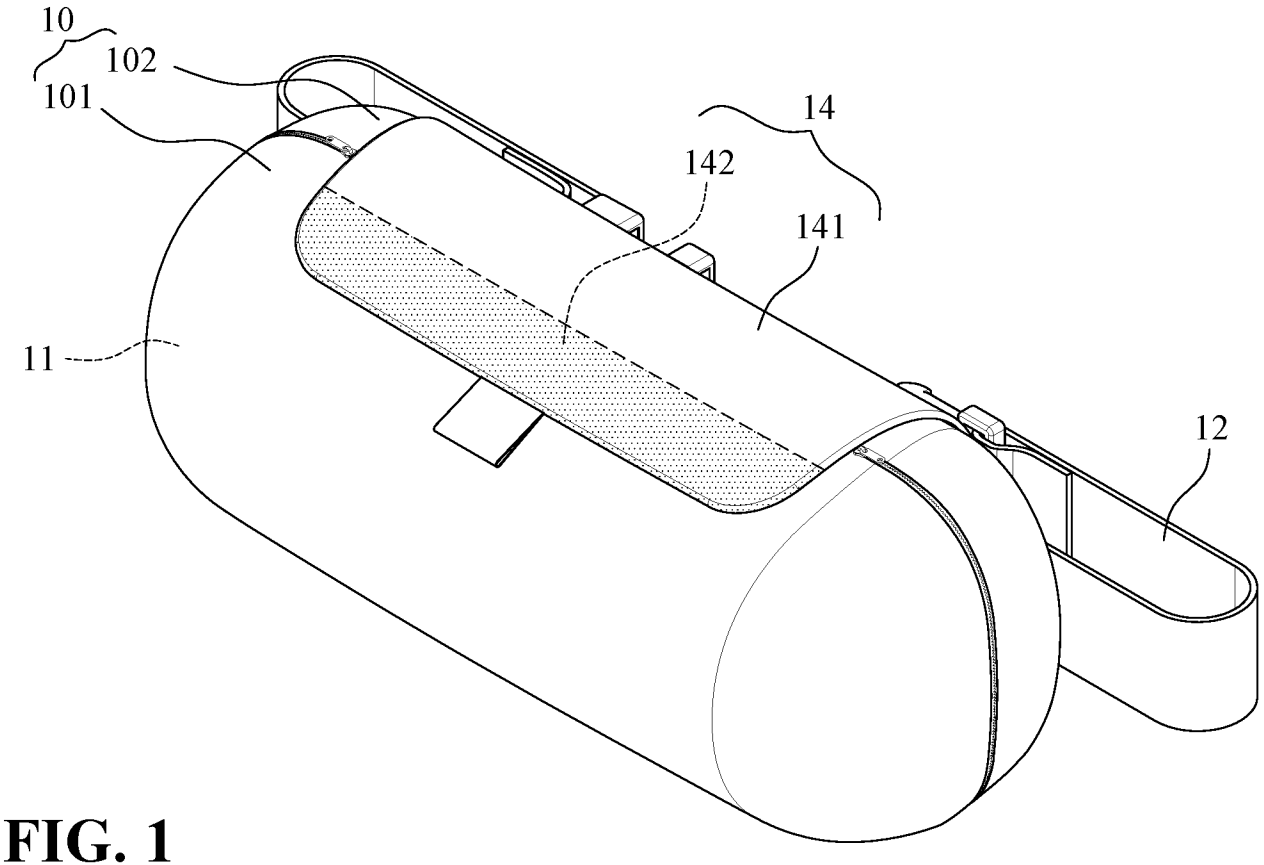
FIG. 1 is a perspective view of the neck pillow bag of a preferred embodiment of the present invention.
Figure 2:
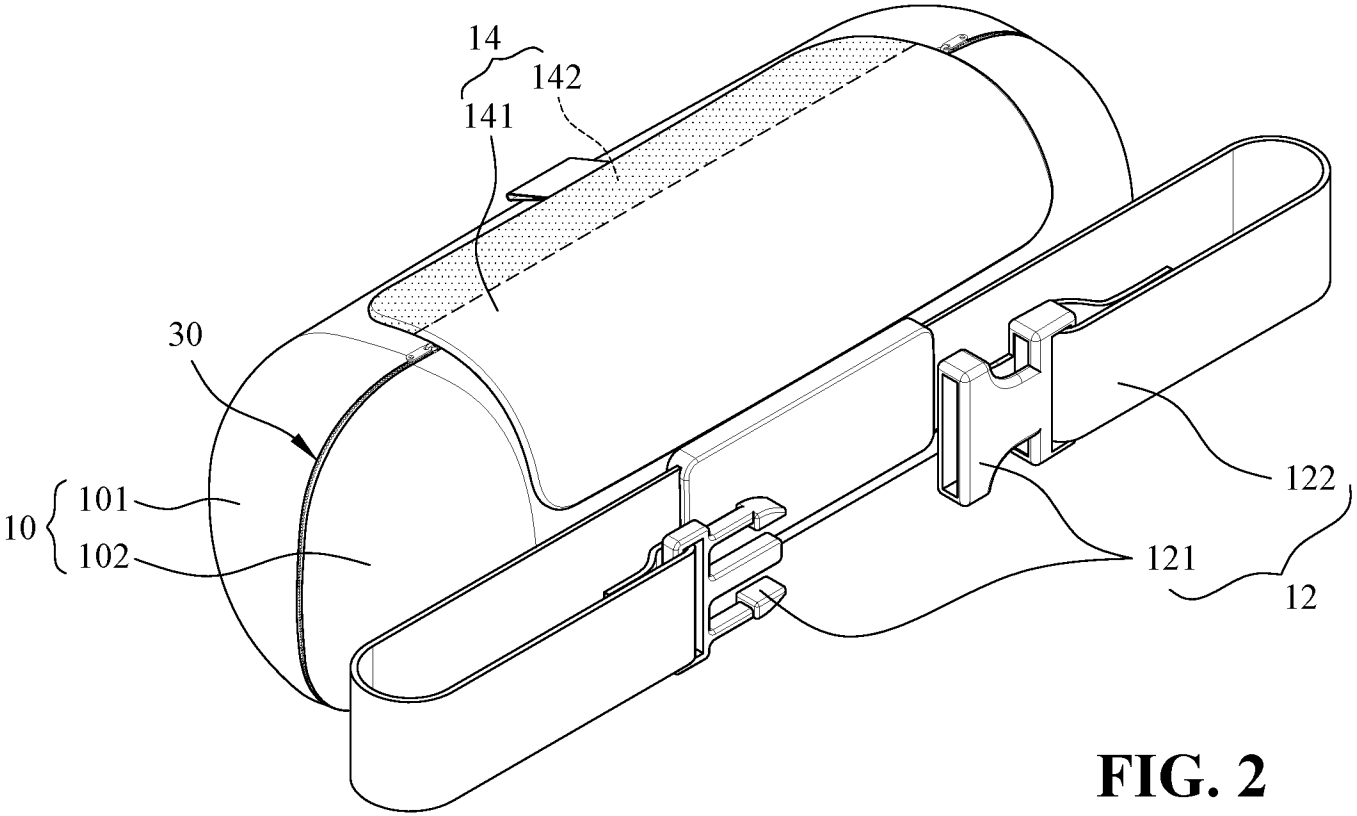
FIG. 2 is another perspective of the neck pillow bag of a preferred embodiment of the present invention.

FIG. 1 is a perspective view of the neck pillow hag of a preferred embodiment of the present invention, and FIG. 2 is another perspective of the neck pillow bag of a preferred embodiment of the present invention from a different angle. The present invention provides a neck pillow bag, comprising a main body 10 and at least one pillow body 20. The following describes the parts of the neck pillow bag in details.

The main body 10 further comprises a first casing 101, a second casing 102, an accommodating space 11 and a fixing portion 12, the accommodating space 11 is formed between the first casing 101 and the second casing 102, the first casing 101 and the second casing 102 are partially connected so that the first casing 101 is able to be opened and closed with respect to the second casing 102, and the fixing portion 12 is disposed on the second casing 102. However, the disposition of the fixing portion 12 is not limited therein, and thus can also be disposed on the first casing 101 depending on design requirement.

Preferably, the main body 10 is a casing with elasticity. When the neck of the user rests on the main body 10, the surface of the main body 10 will be slightly concave, while maintaining the bask outline.

Wherein, the first casing 101 and the second casing 102 are partially connected to each other by glue connection, seam connection or pivot connection, so that the first casing 101 can be opened or closed with respect to the second casing 102 however, the connection mechanism is not limited to the aforementioned and can be changed to a structure with the same function as required.

In a referred embodiment of the present invention, the main body 10 further comprises an assembly portion 14; the assembly portion 14 comprises a first connector 141 and a second connector 142, the first connector 141 is disposed on the second casing 102, the second connector 142 is disposed on the first casing 101; when the first connector 141 and the second connector 142 are assembled, the first casing 101 and the second casing 102 are connected and fixed; when the first connector 141 and the second connector 142 are not assembled, the first casing 101 and the second casing 102 are separated.

Preferably, the assembly portion 14 is disposed on the other top side of the first casing 101 and the second casing 102 opposite to where the first casing 101 and the second casing 102 are partially connected; when the first connector 141 and the second connector 142 are not assembled, the first casing 101 and the second casing 102 can be separated from the top side.

Specifically, the first connector 141 and the second connector 142 can be a hook-and-loop fastener, which can be fastened and separated quickly, and is convenient for users to assemble, however, the first connector 141 and the second connector 142 are not limited to the aforementioned and can be changed to a structure with the same function, such as a press buckle or a magnet.

Refer to FIG. 2. The neck pillow bag of the present invention further comprises a zipper 30; the zipper 30 is disposed at edges of the first casing 101 and the second casing 102 to allow the first casing 101 and the second casing 102 to open or close with respect to each other to prevent dust from entering the accommodation space 11 to pollute the pillow bod 20, When the first casing 101 and the second casing 102 of the main body 10 are closed, and the neck of the human body rests on the main body 10, the zipper 30 can be pulled up to slightly enhance the support to the first casing 101 and the second casing 102 to avoid deformation, so as to achieve the effect of sealing and supporting in the accommodating space 11.

In a preferred embodiment of the present invention, the fixing portion 12 comprises two assembly buckles 121 and a fastening strap 122; the two assembly buckles 121 are respectively disposed at both ends of the fastening strap 112, and the two assembly buckles 121 are detachably connected with each other. The fixing portion 12 is used to fix the present invention to the pillars of a seat 50 and a headrest 51, so that the main body 10 is fixed to a position where the neck is when the user sits to support the user, so the fixing portion 12 can also be a hook-and-loop fastener that can be fixed to the pillar.

Specifically, the middle section of the fastening strap 122 is connected to the second casing 102 of the main body 10, and two assembly buckles 121 are provided at both ends of the fastening strap 122. In the preferred embodiment of the present invention, the two assembly buckles 121 can be a male buckle and a female buckle of an insertion buckle, which can be quickly assembled and disassembled. However, the structure of the two assembly buckles 121 are not limited to the aforementioned and can be changed to a structure with the same function and able to be quickly disassembled, such as, magnet, quick release buckle, or other types of buckles.

Figure 3:
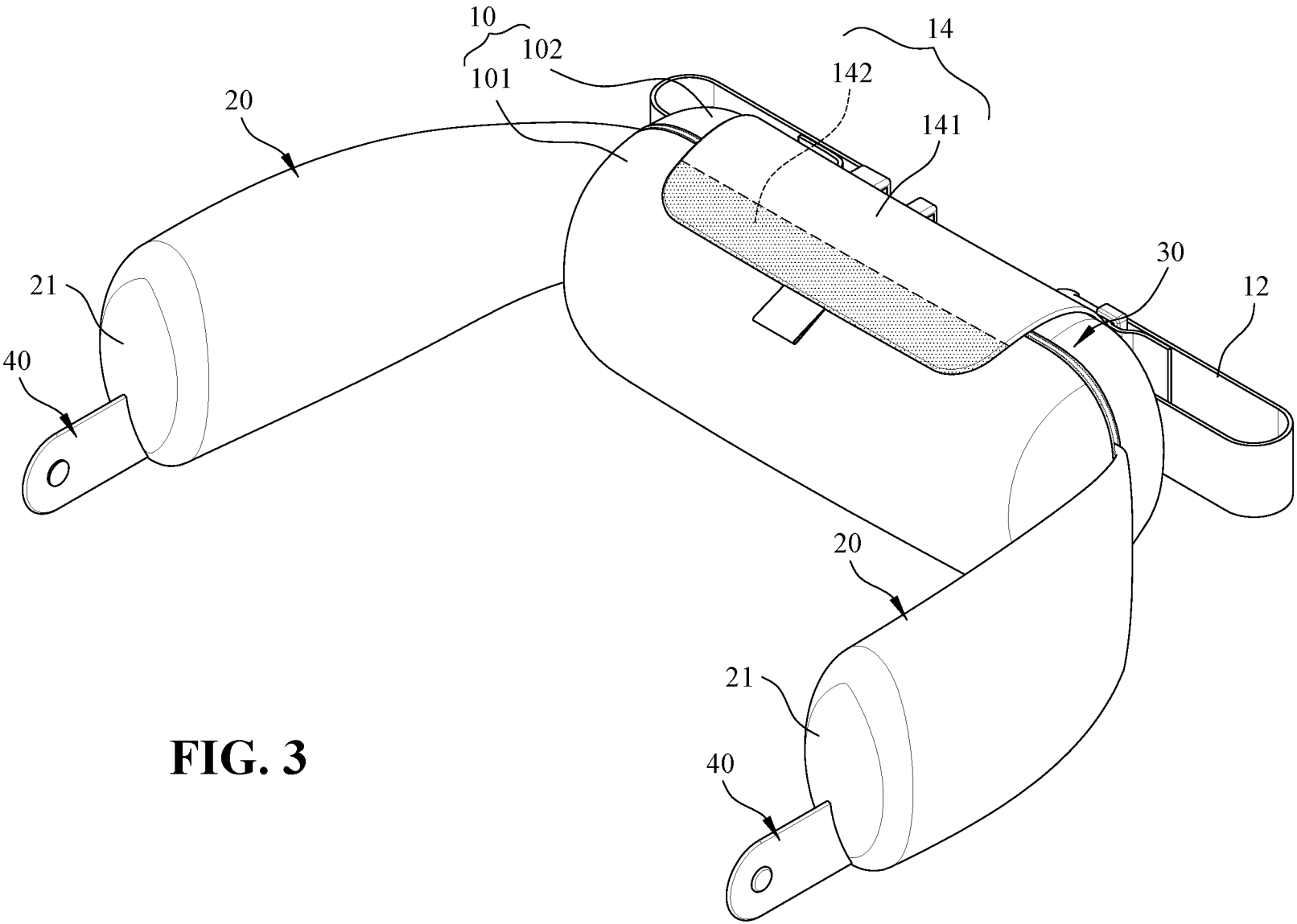
FIG. 3 is a perspective view of the pillow body of the neck pillow bag of the preferred embodiment of the present invention being pulled out.
Figure 4:
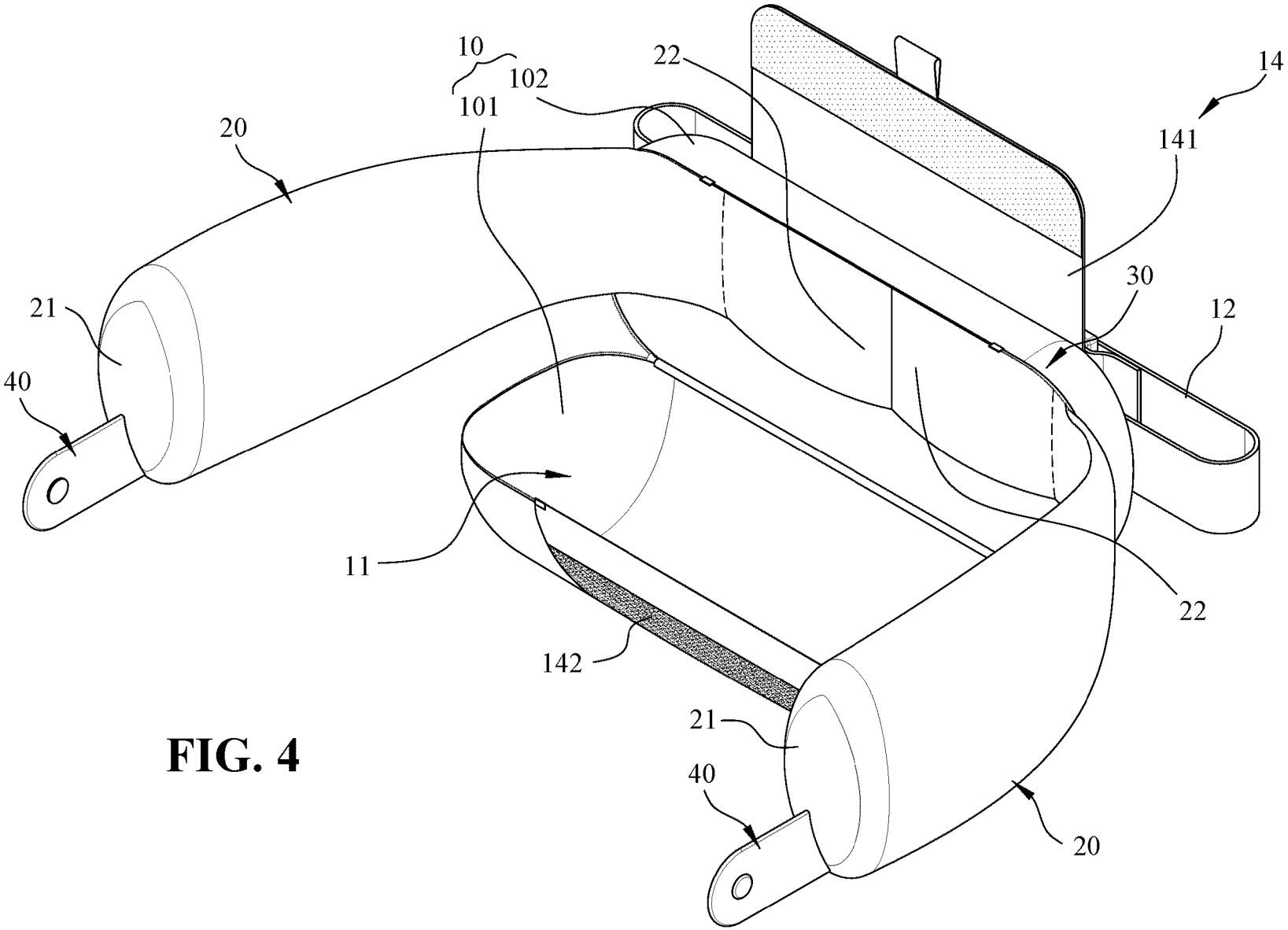
FIG. 4 is a schematic view of the opening of the neck pillow bag in the preferred embodiment of the present invention.

FIG. 3 is a perspective view of the pillow body of the neck pillow bag of the preferred embodiment of the present invention being pulled out. FIG. 4 is a schematic view of the opening of the neck pillow bag in the preferred embodiment of the present invention. As shown in FIG. 3 and FIG. 4, the at least one pillow body 20 is disposed inside the accommodating space 11, a first end 22 of the at least one pillow body 20 is connected to the main body, and a second end 21 of the at least one pillow body 20 is optionally retrievable from the accommodating space 11.

Specifically, in a preferred embodiment of the present invention, two pillow bodies are included in the neck pillow bag. The first ends 22 of the two pillow bodies 20 are respectively disposed inside the accommodation space 11, and the second ends 21 can be optionally located inside the accommodation space 11, or optionally retrieved from the accommodating space 11.

In a preferred embodiment of the present invention, the first ends 22 of the two pillow bodies 20 are connected respectively to the second casing 102 inside the accommodation space 11. However, the connection is not limited to the aforementioned. The first ends 22 of the two pillow bodies 20 can also be connected respectively to the first casing 101 inside the accommodation space 11, instead.

In a preferred embodiment of the present invention, each pillow body 20 is provided inside with one of a plurality of styrofoam balls. Through the plurality of styrofoam balls with smaller diameters, when the user leans his neck on the pillow bodies 20, the pillow bodies 20 can be tuned to the shape of the neck of the human body, and the pillow bodies 20 can be more snug onto the contour of the neck. Which is more comfortable. Other materials, such as, foam, or latex can also be used.

In a preferred embodiment of the present invention, the neck pillow bag comprises two connection portions 40, which are respectively disposed on the second ends 21 of the two pillow bodies 20, and the two connection portions are detachably assembled with each other. Preferably, the two connection portions 40 can be a soft magnet, which can be quickly assembled and disassembled, and does not strangle the neck during use. However, the structure of the two connection portions 40 is not limited to the aforementioned and can be changed to a structure providing the same function and able to be quickly disassembled, such as a buckle, a hook-and-loop fastener, or a quick-release buckle.

Figure 5:
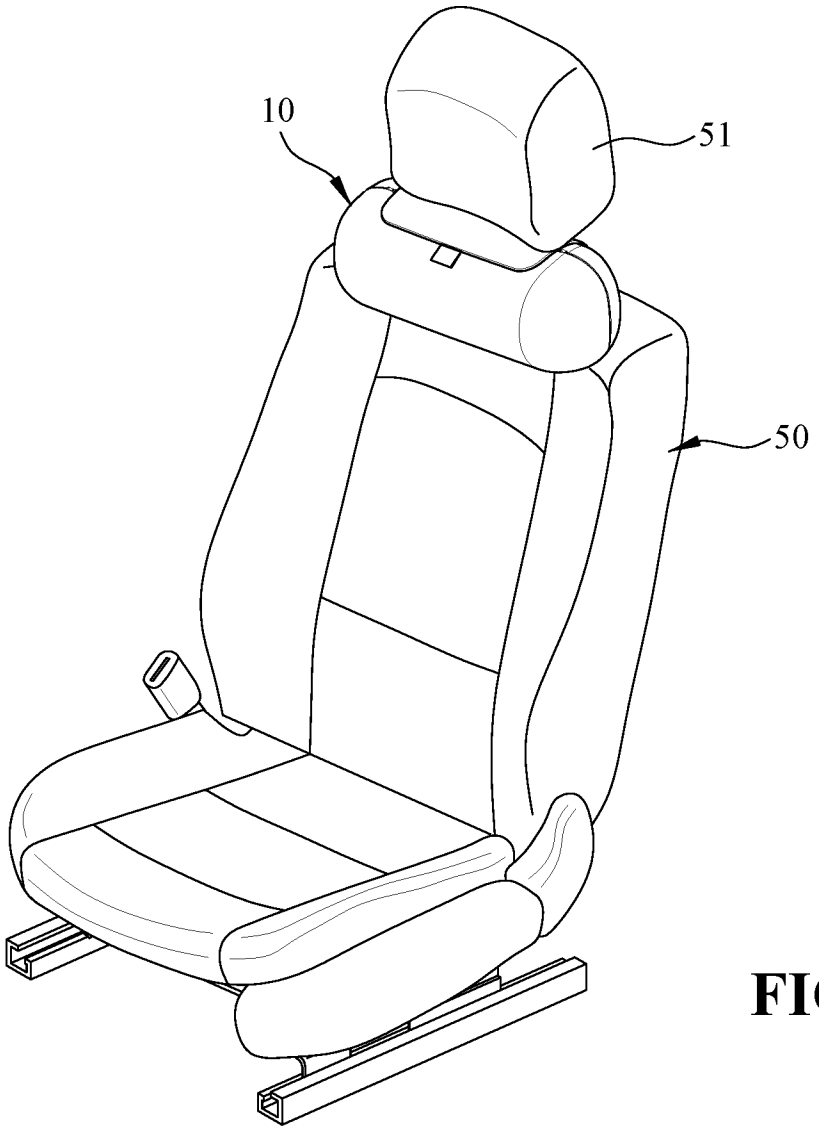
FIG. 5 is a schematic view of the neck pillow bag mounted on the seat according to the preferred embodiment of the present invention.

FIG. 5 is a schematic view of the neck pillow bag mounted on the pillars of the seat 50 and the headrest 51 according to the preferred embodiment of the present invention. As shown in FIG. 5, during mounting, the fastening strap 122 of the fixing portion 12 is first bypassed the pillar, and the assembly buckles 121 at both ends of the fastening strap 122 are interlocked to achieve the function of fixing the main body 10. The main body 10 is mounted in between the seat 50 and the headrest 51, at the position where the user's neck can lean on when the user rides on the seat 50 to achieve a better neck support effect.

Wherein, because the main body 10 of the present invention has elasticity, when the neck leans against the first casing 101 of the main body 10, the surface of the main body 10 is slightly recessed while maintaining the basic appearance of the contour. In addition, there is a cushion on the surface of the first casing 101, which increases the comfort of resting.

Figure 6:
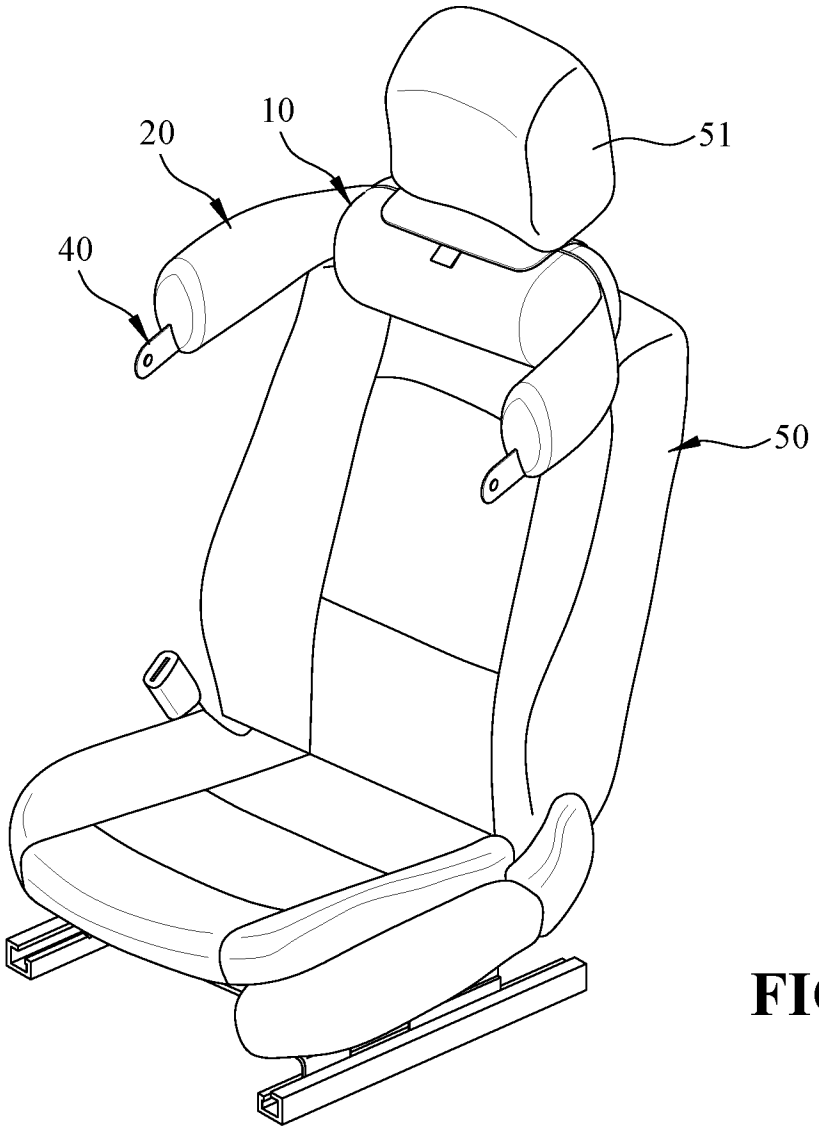
FIG. 6 is a schematic view of the pillow body of the neck pillow bag of the preferred embodiment of the present invention being pulled out.

Refer to FIG. 3 and FIG. 6. FIG. 6 is a schematic view of the pillow body 20 of the neck pillow bag of the preferred embodiment of the present invention being pulled out. When it is necessary to use the pillow body 20 in the accommodation space 11, the first step is to separate the first connector 141 and the second connector 142 of the assembly portion 14, and then separate the first casing 101 and the second casing 102 from the top side. Then, the second ends 21 of the two pillow bodies 20 can be taken out from the accommodation space 11.

After the second ends 21 of the two pillow bodies 20 are taken out, the first casing 101 and the second casing 102 can be closed. Then, the first connector 141 and the second connector 142 can be assembled to connect and fix the first casing 101 and the second casing 102.

Figure 7:
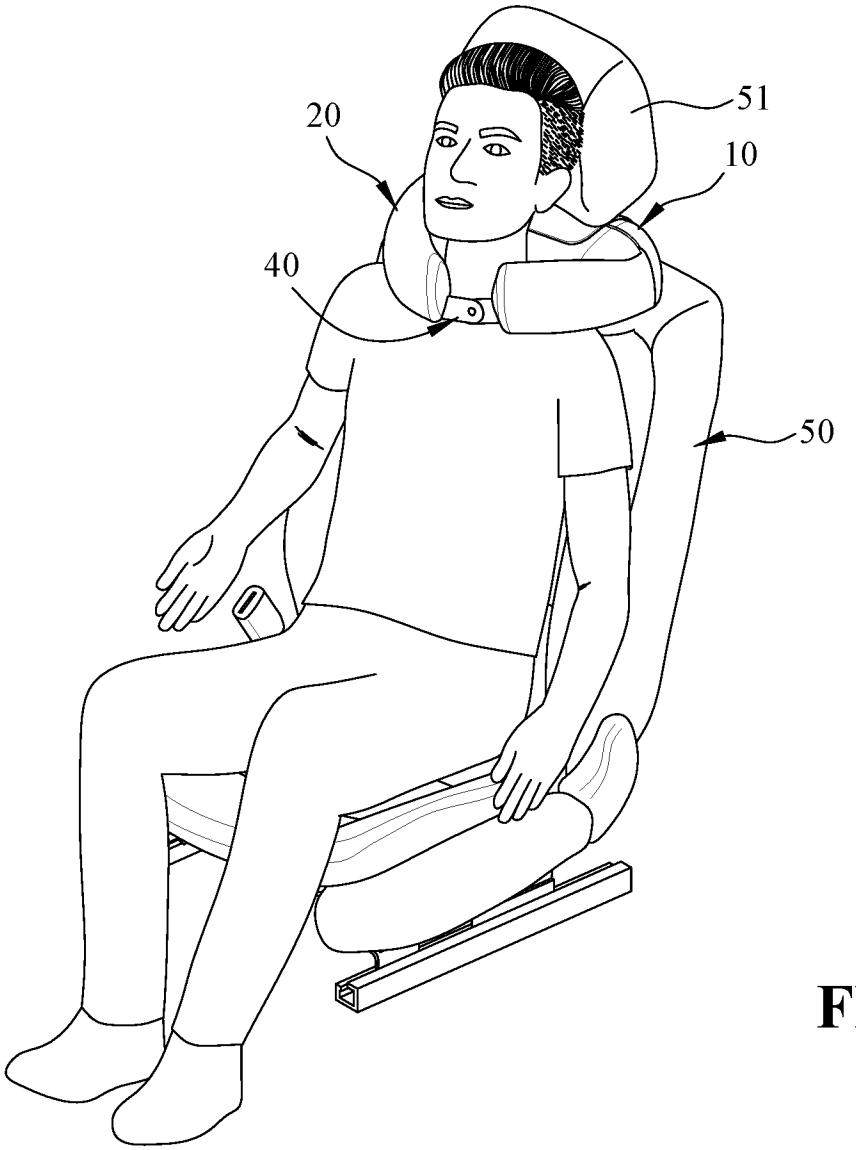
FIG. 7 is a schematic view of the use of the neck pillow bag of the preferred embodiment of the present invention.

FIG. 7 is a schematic view of the use of the neck pillow bag of the preferred embodiment of the present invention. As shown in FIG. 7, after the user sits in the seat 50, the two pillow bodies 20 can surround the user's neck, and then the connection portion 40 provided at the second ends 21 of the second pillow bodies 20 can be connected to achieve the function of supporting and fixing the neck of the user, prevent the body from skewing and tilting when sitting in the seat 50 during long-distance travel, and avoiding the trouble to passengers in adjacent seats.

After use, the user can separate the first connector 141 and the second connector 142 of the assembly portion 14, and separate the first casing 101 and the second casing 102 from the top side. The second ends 21 of the two pillow bodies 20 are respectively retracted into the accommodating space 11 of the body 10, and then the first connector 141 and the second connector 142 are assembled to make the first casing 101 and the second casing 102 connected and fixed, and the two pillow bodies 20 are stored.

The advantages of the present invention is that the main body 10 is fixed to the seat 50 by the fixing portion 12, and the two pillow bodies 20 surround the neck of the passenger, and are fastened together by the connection portions 40, so as to prevent the user from leaning or tilting to bother passengers in adjacent seats when the user sleeps in the seat 50.

Furthermore, the present invention uses the accommodation space 11 of the main body 10 to store the pillow bodies 20 after the user uses the pillow bodies 20, which is convenient for the user to carry, store and place.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A neck pillow bag, comprising:

a main body, the main body further comprising a first casing, a second casing, an accommodating space and a fixing portion, the accommodating space being formed between the first casing and the second casing, a first connector being disposed on the second casing, a second connector being disposed on the first casing, the first casing and the second casing being partially connected for the first casing to be opened and closed with respect to the second casing, and the fixing portion being disposed on the second casing; and at least one pillow body, disposed inside the accommodating space, a first end of each pillow body of the at least one pillow body being connected to the main body, and a second end of each pillow body of the at least one pillow body being optionally retrievable from the accommodating space;

wherein the first casing and the second casing can be closed with the first connector and the second connector being assembled to connect and fix the first casing and the second casing after the at least one pillow body and the second end are taken out of the accommodating space.

2. The neck pillow bag according to claim 1, wherein the first casing and the second casing are connected through a mechanism of glue, seam or pivot.

3. The neck pillow bag according to claim 2, wherein when the first connector and the second connector are assembled, the first casing and the second casing are connected and fixed; when the first connector and the second connector are not assembled, the first casing and the second casing are separated.

4. The neck pillow bag according to claim 1, wherein the fixing portion comprises two assembly buckles and a fastening strap; the two assembly buckles are respectively disposed at both ends of the fastening strap, and the two assembly buckles are detachably connected with each other.

5. The neck pillow bag according to claim 1, wherein the at least one pillow body is provided inside with one of a plurality of styrofoam balls, foam, or latex.

6. The neck pillow bag according to claim 1, wherein the neck pillow bag comprises two pillow bodies and two connection portions, which are respectively disposed on the second ends of the two pillow bodies, and the two connection portions are detachably assembled with each other.

7. The neck pillow bag according to claim 4, wherein the neck pillow bag comprises two pillow bodies and two connection portions, which are respectively disposed on the second ends of the two pillow bodies, and the two connection portions are detachably assembled with each other.

* * * * *